US007662055B2

(12) United States Patent
Cutlip

(10) Patent No.: US 7,662,055 B2
(45) Date of Patent: Feb. 16, 2010

(54) LACROSSE HEAD WEIGHT TRAINING DEVICE

(75) Inventor: Robert W. Cutlip, 336 Butternut Ct., Millersville, MD (US) 21108

(73) Assignee: Robert W. Cutlip, Millersville, MD (US)

( * ) Notice: Subject to any disclaimer, the term of this patent is extended or adjusted under 35 U.S.C. 154(b) by 276 days.

(21) Appl. No.: 11/833,995

(22) Filed: Aug. 4, 2007

(65) Prior Publication Data

US 2008/0032825 A1 Feb. 7, 2008

Related U.S. Application Data

(60) Provisional application No. 60/821,694, filed on Aug. 7, 2006.

(51) Int. Cl.
*A63B 59/02* (2006.01)
*A63B 65/12* (2006.01)

(52) U.S. Cl. ..... 473/513; D21/724; 473/422

(58) Field of Classification Search ..... 473/513, 473/512, 505, 422; D21/724
See application file for complete search history.

(56) References Cited

U.S. PATENT DOCUMENTS

| | | | | | |
|---|---|---|---|---|---|
| 3,279,008 | A * | 10/1966 | Wallach | 24/16 PB |
| 3,330,560 | A * | 7/1967 | Higdon | 473/437 |
| 3,913,911 | A * | 10/1975 | Peterson | 473/519 |
| 4,108,433 | A * | 8/1978 | Althoff | 473/437 |
| 6,929,612 | B2 * | 8/2005 | Mangano | 601/71 |
| 7,407,451 | B2 * | 8/2008 | Velasquez | 473/422 |
| 2006/0154755 | A1 * | 7/2006 | Velasquez | 473/513 |

* cited by examiner

*Primary Examiner*—Gene Kim
*Assistant Examiner*—M Chambers

(57) ABSTRACT

The present invention relates to devices for physical training purposes and specifically to training weights for use on a lacrosse head. This weight training device for lacrosse distributes weight uniformly around the entire perimeter of a lacrosse head, is easy to attach to lacrosse heads from multiple manufacturers, is unobtrusive to be used during ball handling, and is available in multiple weight models to address the needs of beginners to professionals.

15 Claims, 2 Drawing Sheets

LACROSSE HEAD WEIGHT TRAINING DEVICE

PRIORITY CLAIM

The present invention claims priority to U.S. Provisional Patent Application No. 60/821,694, filed Aug. 7, 2006, entitled "Lacrosse Head Weight Training Device," which is hereby incorporated by reference in its entirety.

FIELD OF THE INVENTION

The present invention relates to devices for physical training purposes and specifically to training weights for use on a lacrosse head.

BACKGROUND OF THE INVENTION

There are many current styles and implementations of training weights for use to improve the strength and performance of athletes. A major drawback of many of the existing weight devices is that they rely on the use of lead, which is a hazardous substance. Lead plates or bars are used in these existing devices due to lead's ability to be hand formed and then maintain the hand formed shape. However, the U.S. Consumer Product Safety Commission has issued guidance to manufacturers, importers, distributors, and retailers warning against the use of lead in consumer products.

The majority of training weights are general purpose devices such as ankle weights, weight vests, wrist weights, and weight belts that attach to the athlete's body. Another general category is weighted devices that mimic the shape and size of sports equipment. Two such devices are outlined in United States Patent Applications 20040176194 (Lacrosse training device) and 20050261075 (Sports training and conditioning device). The other general category includes training weights which attach to sports equipment and are targeted at specific sports such as baseball, tennis, golf, hockey, and lacrosse. The majority of these devices are intended to be attached to the handle or shaft of the sports equipment. Examples are outlined in United States Patent Applications 20050277491 (Adjustable weight training belt for a baseball bat), 20040259666 (Weighted training tape), 20020128085 (Swing weight) and U.S. Pat. No. 5,993,325 (Flexible swing weight). The category of the present invention is those devices that attach to the head of the sports equipment. One such device for tennis rackets is outlined in U.S. Pat. No. 3,330,560, issued Jul. 11, 1967.

Two weight training products are currently found marketed in the general merchandise catalogs for lacrosse. The first product is a weighted lacrosse handle marketed by Warrior, the Powermaster Training Handle and is not in the category of the present invention. The second product is the Warrior Weighted Stick Doughnut and is in the category of the present invention. This second product attaches at the bottom of the lacrosse head and around the top of the lacrosse handle, concentrating the entire weight locally. A disadvantage of the second product and other prior art weighted training devices is the use of fabric as the outer casing to hold the weight medium. Fabric is flexible and allows these prior art training weights to wrap around sports equipment and an athlete's body parts. However, fabric has no structural rigidity. This lack of structural rigidity allows undue relative motions of the prior art devices during use. With a fabric casing, both shifting of the weight device relative to the sports equipment and shifting of the weight medium relative to the fabric casing occur. These undesirable relative motions are exaggerated by the back and forth rotational cradling motion required in lacrosse.

A basic stick handling technique that is unique to the sport of lacrosse is cradling. Cradling is essential to keep the ball secure in the lacrosse head pocket while a player is running, dodging, and being checked by other players that are attempting to force the ball to be dropped. Cradling consists of rotating the lacrosse stick back and forth about the axis of the lacrosse handle to keep the ball held in the pocket of the lacrosse head. To avoid checks by other players, the player cradling the ball will also abruptly change the position of the lacrosse stick in reference to his body. To maintain a balanced feel during these lacrosse stick handling motions, a weighted attachment must distribute its weight uniformly around the entire perimeter of the lacrosse head and not allow shifting of its self and its weight medium.

The application of attaching a weighted device to the perimeter of a lacrosse head creates multiple issues that must be addressed with novel approaches. Multiple manufacturers' head designs, multiple pocket styles, and multiple stringing methods combine to demand a novel solution. Therefore the device design must include features that allow the device to conform to multiple shapes and an attachment method that easily adapts to available securing points on any given combination of head, pocket, and stringing method.

SUMMARY OF THE INVENTION

The present invention relates to devices for physical training purposes and specifically to training weights for use on a lacrosse head. This weight training device for lacrosse distributes weight uniformly around the entire perimeter of a lacrosse head, is easy to attach to lacrosse heads from multiple manufacturers, is unobtrusive to be used during ball handling, does not require the use of lead plates or bars as a weight medium, and is available in multiple weight models to address the needs of beginners to professionals.

The principal object of this invention is to provide a training weight attachment for a lacrosse head.

A further object of this invention is to provide a training weight attachment for a lacrosse head which provides uniform distributed weight around the entire perimeter of the lacrosse head.

A further object of this invention is to provide a training weight attachment for a lacrosse head with a single seamless weight compartment.

A further object of this invention is to provide a training weight attachment for a lacrosse head which is hand shapeable by children or adults.

A further object of this invention is to provide a training weight attachment for a lacrosse head which is hand shapeable by children or adults and maintains its formed shape during installation and use.

A further object of this invention is to provide a training weight attachment for a lacrosse head which does not require lead plates or bars as a weight medium to allow hand shaping and to maintain the formed shape during use.

A further object of this invention is to provide a training weight attachment for a lacrosse head which is easy to attach and remove.

A further object of this invention is to provide a training weight attachment for a lacrosse head with an attachment method that can be relocated by the user anywhere along the attachment's length to easily adapt to the available securing points on any given combination of head, pocket, and stringing method.

A further object of this invention is to provide a training weight attachment for a lacrosse head which does not move during use.

A further object of this invention is to provide a training weight attachment for a lacrosse head that does not allow the weight medium to shift during use.

A further object of this invention is to provide a training weight attachment for a lacrosse head with a design that is easy to manufacture multiple weight versions with the same dimensions.

A further object of this invention is to provide a training weight attachment for a lacrosse head with a design that is easy to manufacture multiple color versions with the same dimensions.

A further object of this invention is to provide a training weight attachment for a lacrosse head which is unobtrusive and can be used during ball handling.

The preferred embodiment of the present invention has been built and tested. Multiple progressive weight models ranging from four to twenty ounces have been developed to span the training needs from beginners to advanced players. The preferred embodiment has been shown to have the adaptability to fit most lacrosse heads on the market.

DETAILED DESCRIPTION

Figure 1:
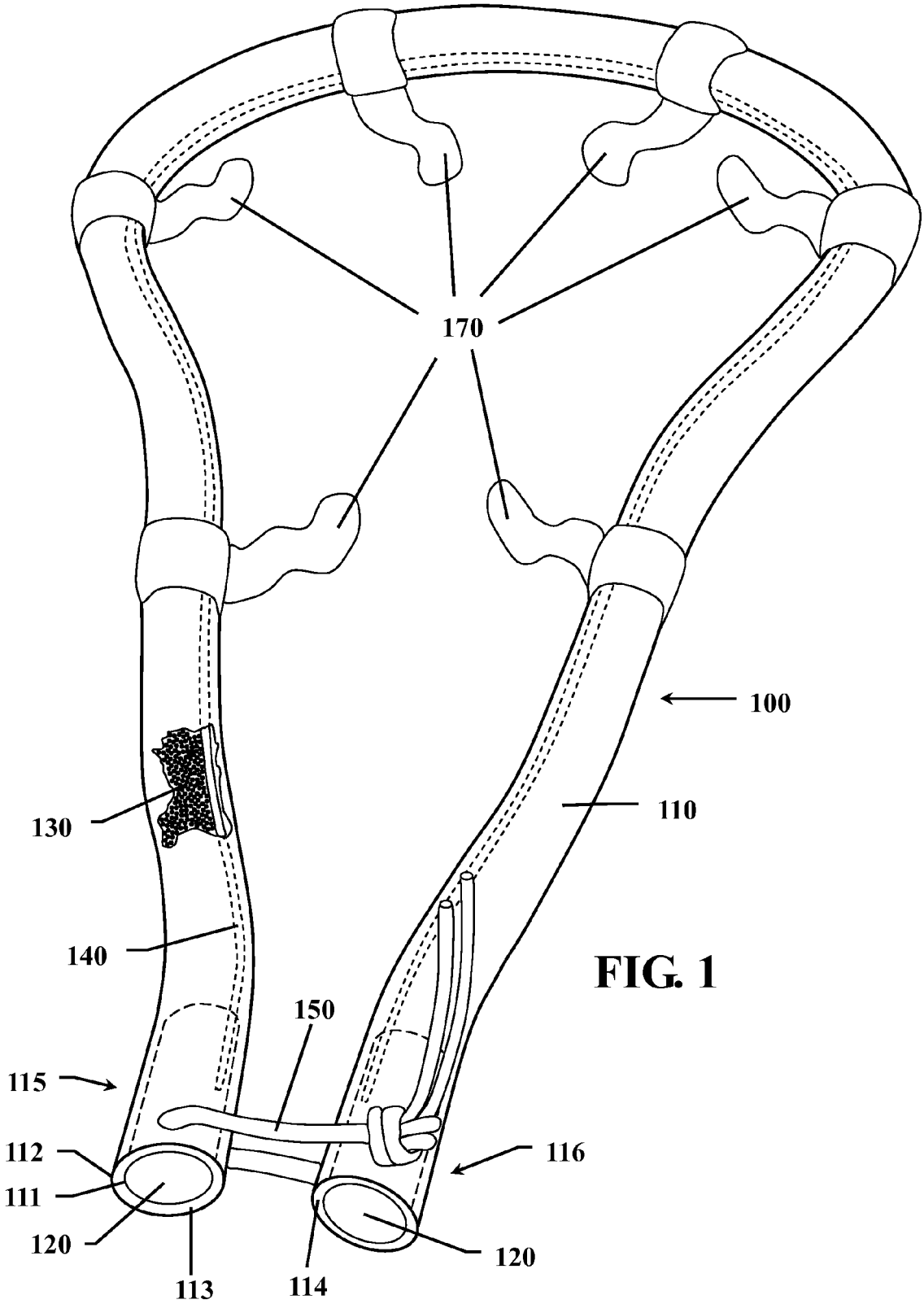
FIG. 1 is a perspective view of the preferred embodiment of the lacrosse weight training device.

Referring to FIG. 1, the preferred embodiment of the present invention of a lacrosse weight training device 100 includes a tubular outer casing 110, two end plugs 120, weight medium 130, spine 140, cord 150, and attachment straps 170.

The weight medium 130 is comprised of small particles approximately the size and consistency of sand. The use of small particles to fill the interior volume of the outer casing 110 distributes the weight uniformly along the device 100 length. As adjacent particles of the weight medium 130 readily shift in relationship to each other, the use of small particles allows the device 100 to be easily formed by hand to the shape of any lacrosse head. The small particles may be of various density materials such as sand, aluminum blasting grit, or steel shot. Lead shot would work well, however it is not a desirable material for the weight medium 130 due to its hazardous properties. The use of particles of different density for the weight medium 130 simplifies the manufacturing and packaging of multiple weight versions of the device 100, as the same outer casing 110 length and diameter can be used. The use of small particles instead of large discrete weights also allows the homogenous mixture of particles of different densities to refine the weight of the device 100. During manufacture, the weight medium 130 is easily poured into the outer casing 110.

The outer casing 110 has a seamless, uniform, one piece, tubular construction. The outer casing 110 is of a flexible yet durable material. The outer casing 110 has an inner surface 111, an outer surface 112, an end 113, and an opposite end 114. The outer casing 110 encircles the weight medium 130 and constrains the weight medium 130 against shifting during use of the device 100. The outer casing 110 must be flexible, to be easily shaped to a lacrosse head, yet rigid enough so as not to collapse on its self. The ability of the outer casing 110 to not collapse on its self allows the weight medium 130 to be easily poured into the outer casing 110 during manufacture of the device 100, and prevents shifting of the weight medium during use. The outer casing 110 should be readily available in multiple colors to facilitate the manufacture of numerous color varieties of the device 100. The outer casing 110 is of sufficient length to extend around the entire perimeter of a lacrosse head. In the preferred embodiment, the outer casing 110 is PVC tubing with an outer diameter that allows it to be unobtrusive on the back side of a lacrosse head and a durometer range of approximately seventy to eighty on the Shore A scale.

The two ends 115 and 116 of the device 100 are fitted with plugs 120 that confine the weight medium 130 within the outer casing 110 and restrain the weight medium 130 from shifting during use. The outer diameter of the plugs 120 correspond to the inner diameter of the outer casing 110. The plugs 120 may be fabricated from materials of various densities to refine the overall weight of the device 100. Materials such as PVC, DELRIN, nylon, aluminum, and steel can be used for the end plugs 120.

The ends 115 and 116 of the device 100 are secured together though the outer casing 110 and the end plugs 120 with a cord 150. In the preferred embodiment, the cord 150 is elastic cord of approximately one eighth inch in diameter with a one hundred percent stretch.

Internal to the outer casing 110 and captured between the end plugs 120 is the spine 140. The spine 140 has physical properties that allow hand forming of the device 100, yet the spine 140 maintains the formed shape of the device 100 during use. Retaining the formed shape during use minimizes the attachment points required to secure the device to the lacrosse head and prevents undue motion during use. Also, maintaining the formed shape of a lacrosse head while the device 100 is not attached to a lacrosse head provides the user with the perception of a high quality product. Although captured inside and between the end plugs 120 to prevent puncture of the outer casing 110, the spine 140 is allowed some limited movement within the end plugs 120 along the length of the device 100. This limited movement along the length facilitates forming the device 100 to the perimeter of a lacrosse head. In the preferred embodiment, the spine 140 is fabricated of ten gauge solid copper wire. Although included in the preferred embodiment of the device 100, the spine 140 is not intended to limit the scope of the invention. In a lower perceived quality embodiment, the spine 140 would not be included and thus the device 100 would be less expensive to manufacture. In the "spineless" embodiment, a higher number of attachment points are likely to be required.

Figure 2:
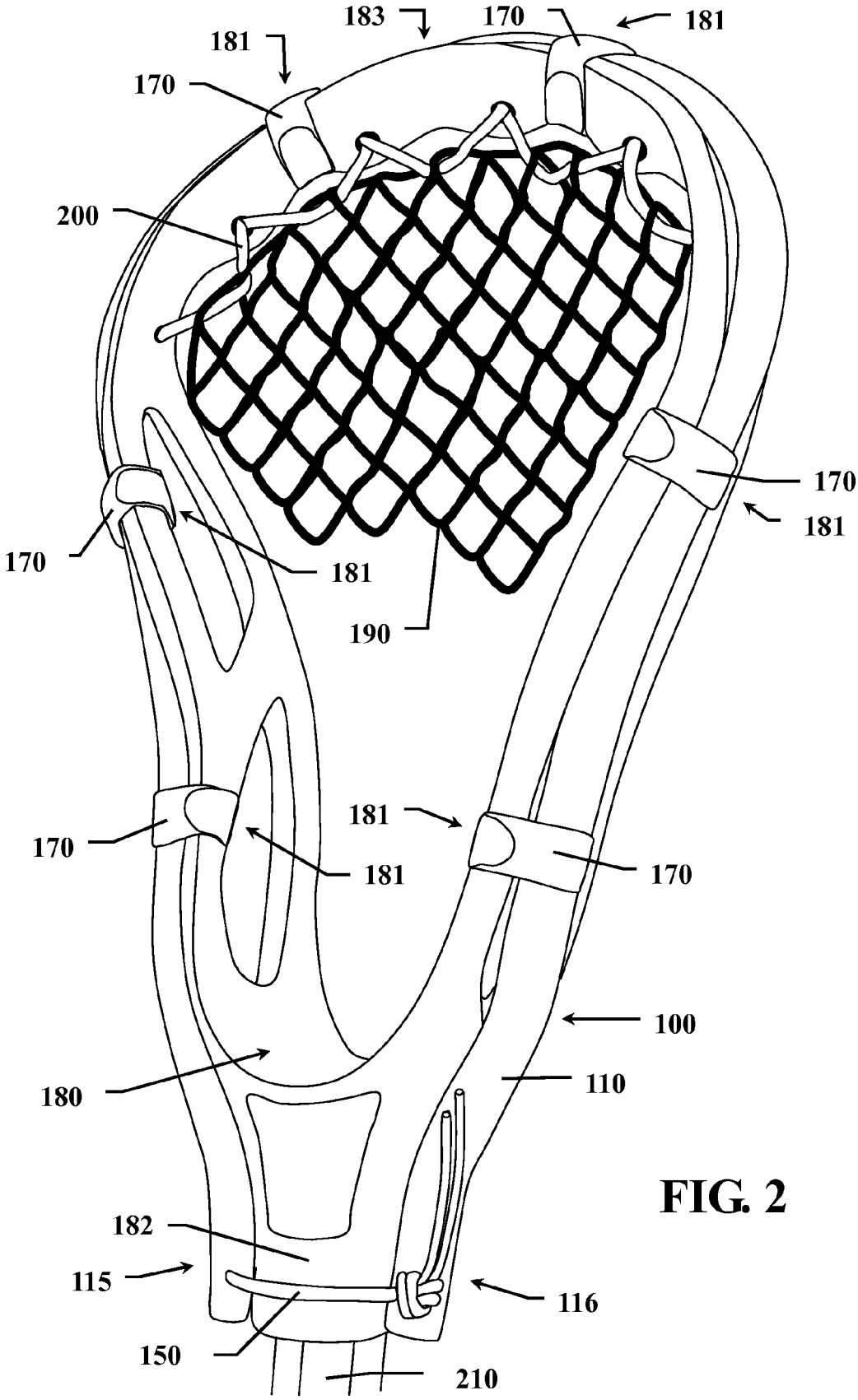
FIG. 2 is a perspective view of the preferred embodiment of the lacrosse weight training device secured to the head of a lacrosse stick.

Referring now to FIG. 2, the preferred embodiment of the lacrosse weight attachment device 100 is secured to the head 180 of a lacrosse stick. As shown, the device 100 encircles the entire perimeter of the lacrosse head 180 and has been custom formed by hand to the shape of the lacrosse head 180. In particular, during installation, a child or adult can shape the weight training device 100 without the use of any tool to the perimeter shape of any manufacturer's lacrosse head 180. After forming, the device 100 will maintain the shape of the lacrosse head 180 to facilitate the easy attachment of the device 100 to the lacrosse head 180. To be unobtrusive during use, taking the form of the lacrosse head 180 is essential so the device 100 can be securely fastened to the head 180 yet not interfere with the pocket 190 or stringing 200. Also, the ability of the device 100 to maintain its shape during use minimizes the attachment points 181 required to secure the device 100 to the lacrosse head 180 and prevents undue motion during use. The two attachment points 181 shown in the scoop area 183 of the lacrosse head 180 are not required in all embodiments of the device 100. However, in an embodiment of the device 100 without the spine 140 (as depicted on FIG. 1) the attachment points 181 in the scoop area 183 would likely be required to prevent undue movement of the device 100 during use.

Still referring to FIG. 2, the device 100 is attached to the back side of a lacrosse head 180 with multiple self gripping hook and loop straps 170. The small device profile and attachment to the back side of the lacrosse head 180 allows the use of the device 100 without interfering with normal lacrosse stick handling, catching, throwing, and shooting. The straps 170 are secured to the outer casing 110, yet may be easily repositioned by hand anywhere along the length of the training device 100 to facilitate fastening to any manufacturer's lacrosse head 180. The ability to reposition the straps 170 along the outer casing 110 is essential to adapt to the available securing points 181 on any given combination of lacrosse head 180, pocket 190, and stringing method 200. The straps 170 are of sufficient length to wrap around the various cross sectional shapes and sizes of lacrosse heads 180. The use of self gripping hook and loop straps 170 allow a minimum number of straps to securely fasten the device to a lacrosse head 180 during use, thus enabling quick and easy installation and removal. The width of the straps 170 is sufficient to distribute the securing force during installation so as to not locally deform the outer casing 110 at the straps 170. In the preferred embodiment, the fastening straps 170 are one half inch wide VELCRO® ONE-WRAP® brand straps.

As shown in FIG. 2, the cord 150 forms a loop though which the handle 210 of the lacrosse stick is passed during installation. The cord 150 secures the two ends 115 and 116 of the weight device 100 to the lacrosse stick preventing undue motion during installation and use. In the preferred embodiment, the size of the loop along with the elastic nature of the cord 150 provide a custom fit to the cross section of various manufacturers' lacrosse head 180 "throat" area 182 or handle 210. It is obvious that alternate methods and materials to the preferred embodiment of the cord 150 can be used. As alternates to the use of an elastic cord of the proper loop size, a non-elastic cord could be used with a cord lock such as those commonly used on jackets to cinch the waist, or a non-elastic cord could simply be tied by the user to fit.

Based on the above detailed description and figures, it can be determined that the novel design elements of the device 100 accomplish all of the stated objectives and embody a unique invention for a weight training device for use on a lacrosse head. However, the detailed descriptions and figures of the embodiments are not meant to limit the scope of the invention. It is intended that the scope of the invention includes modifications of the disclosed embodiments, as well as alternative embodiments of the invention that may be made by those skilled in the art without departing from the spirit of the invention. It is the intention, therefore, to be limited only as indicated by the scope of the claims appended hereto.

I claim:

1. A training device attachment which provides a distributed weight around the perimeter of the lacrosse head in combination with a lacrosse head said training device attachment comprising at least one weight compartment wherein said weight compartment is of sufficient length to extend around substantially the entire perimeter of a lacrosse head and wherein said weight compartment is further comprised of a plastic tubular outer casing and wherein said weight attachment further comprising a wire spine to maintain the shape of said training device and at least one attachment strap.

2. A training weight attachment for a lacrosse head as set forth in claim 1 wherein said weight compartment is hand shapeable by children or adults.

3. A training weight attachment for a lacrosse head as set forth in claim 2 wherein said hand shaped form is maintained during installation and use.

4. A training weight attachment for a lacrosse head as set forth in claim 1 wherein said attachment strap(s) can be relocated by the user anywhere along the weight attachment's length.

5. A training weight attachment for a lacrosse head as set in claim 4 wherein said attachment strap(s) are made of self gripping hook and loop material of sufficient length to wrap around the various cross sectional shapes and sizes of lacrosse heads.

6. A training weight attachment for a lacrosse head as set forth in claim 1 wherein said weight compartment is manufactured in different weight versions.

7. A training weight attachment for a lacrosse head as set forth in claim 1 wherein said casing is manufactured in different colors.

8. A training weight attachment for a lacrosse head as set forth in claim 1 wherein said training weight can be used during ball handling.

9. A training weight attachment for a lacrosse head comprising: a weight medium, a tubular outer casing, a conformable spine, and at least one attachment strap wherein said outer casing is of sufficient length to extend around substantially the entire perimeter of a lacrosse head, has an outer diameter that allows said weight attachment to be unobtrusive on the back side of a lacrosse head, and said tubular outer casing has a seamless, uniform, one piece, tubular construction and encircles said weight medium.

10. A training weight attachment for a lacrosse head substantially as set forth in claim 9 wherein said weight medium is manufactured of various density materials such as sand, aluminum blasting grit, or steel shot.

11. A training weight attachment for a lacrosse head as set forth in claim 9 wherein said outer casing is comprised of plastic.

12. A training weight attachment for a lacrosse head substantially as set forth in claim 9 wherein the two ends of said outer casing are fitted with plugs that confine the weight medium within the outer casing.

13. A training weight attachment for a lacrosse head substantially as set forth in claim 9 wherein the two ends of said outer casing are secured together with a cord forming a loop through which the handle of the lacrosse stick is passed during installation.

14. A training weight attachment for a lacrosse head substantially as set forth in claim 9 wherein said spine is hand formable yet the spine maintains the formed shape of the device during use.

15. A training weight attachment for a lacrosse head substantially as set forth in claim 9 wherein said attachment strap(s) may be easily repositioned by hand anywhere along the length of the training device and are made of self gripping hook and loop material of sufficient length to wrap around the various cross sectional shapes and sizes of lacrosse heads.

* * * * *